US007231986B2

(12) United States Patent
Read, Jr. et al.

(10) Patent No.: US 7,231,986 B2
(45) Date of Patent: Jun. 19, 2007

(54) WELL TOOL PROTECTION SYSTEM AND METHOD

(75) Inventors: Dennis M. Read, Jr., Manvel, TX (US); Michael H. Du, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 147 days.

(21) Appl. No.: 10/710,492

(22) Filed: Jul. 15, 2004

(65) Prior Publication Data

US 2005/0056429 A1 Mar. 17, 2005

Related U.S. Application Data

(60) Provisional application No. 60/503,024, filed on Sep. 15, 2003.

(51) Int. Cl.
*E21B 34/08* (2006.01)

(52) U.S. Cl. ..... 166/386; 166/332.8

(58) Field of Classification Search ..... 166/373, 166/386, 332.8

See application file for complete search history.

(56) References Cited

U.S. PATENT DOCUMENTS

| | | | | |
|---|---|---|---|---|
| 3,570,510 | A | 3/1971 | Tsutsumi | |
| 4,597,446 | A | 7/1986 | Helderle | |
| 5,360,069 | A * | 11/1994 | Schmuck et al. | 166/383 |
| 5,411,097 | A | 5/1995 | Manke et al. | |
| 6,079,497 | A * | 6/2000 | Johnston et al. | 166/324 |
| 6,494,269 | B2 * | 12/2002 | French et al. | 166/386 |
| 6,568,489 | B1 | 5/2003 | Hailey | |

FOREIGN PATENT DOCUMENTS

GB 1295373 A 11/1972

* cited by examiner

*Primary Examiner*—William Neuder
(74) *Attorney, Agent, or Firm*—Winstead Sechrest & Minick, P.C.; Kevin P. McEhaney; Jaime A. Castano

(57) ABSTRACT

The system including a well tool having a housing forming a protection fluid chamber in fluid communication with a discharge port, a protection fluid disposed within the protection fluid chamber, and a moveable mechanism in functional connection with the protection fluid chamber in a manner to expel a portion of the protection fluid when the moveable mechanism moves.

10 Claims, 4 Drawing Sheets

WELL TOOL PROTECTION SYSTEM AND METHOD

CROSS REFERENCE TO RELATED APPLICATIONS

This application claims benefit of priority from U.S. Provisional Application No. 60/503,024, filed Sep. 15, 2003 and entitled Well Tool Protection and Debris Removal, Release Mechanism, which is incorporated by reference herein.

BACKGROUND OF INVENTION

The present invention relates in general to well tools and more specifically to a device and method for removing debris from the vicinity of a portion of a well tool and for improved operation of the well tool.

Well tools are operated in harsh downhole conditions often resulting in failure of the well tool to operate as intended. One cause of the failure is due to debris that exists in the well fluid. For example, many well tools include moveable mechanisms such as flapper type valves. These valves are positioned to be readily operated when needed.

However, it is all to common for debris contained in the well fluid to settle around the flapper preventing the flapper from opening or opening completely as desired.

Another problem encountered in existing well tools is failure of a moveable mechanism to operate due to pressure fluctuations in the well bore. These failures tend to occur more often in high downhole pressure environments with large diameter well tools. For example, often one shear pin bears an excessively load resulting in premature shearing of that pin and failure of the well tool to operate properly.

Therefore, it is a desire to provide a system and method for increasing the operational reliability of a well tool. It is a further desire to provide a debris removal system for removing debris from the vicinity of a portion of the well tool to alleviate jamming and tool failure. It is a still further desire to provide a dischargeable protection fluid for removal of debris from proximate a moveable mechanism of a well tool. It is a still further desire to provide an improved release mechanism for operating a well tool.

SUMMARY OF INVENTION

In view of the foregoing and other considerations, the present invention relates to well tools and more specifically to a system and method for removing debris from proximate a well tool.

Accordingly, a well tool protection system and method is provided. The system including a well tool having a housing forming a protection fluid chamber in fluid communication with a discharge port, a protection fluid disposed within the protection fluid chamber, and a moveable mechanism in functional connection with the protection fluid chamber in a manner to expel a portion of the protection fluid when the moveable mechanism moves.

The housing may be a part of the well tool or a member attached to an existing well tool. The housing may include a portion of the tubing or casing.

The discharge port may be positioned in any position wherein it is desired to remove debris from the vicinity of the well tool. For example, in a well tool, such as a flapper type formation or tubing isolation valve, it may be desired to position the discharge port proximate the back of the flapper. It may further be desired to include more than one discharge port. Additionally, it may be desired to design the discharge port to achieve a type of discharge fluid flow.

It may be desired for the moveable mechanism to include an operational feature of the well tool. In an embodiment of the present invention the moveable mechanism includes a slide sleeve that carries the flapper. When the slide sleeve is actuated to move downward the flapper may be moved from the closed to the open position. Utilizing the slide sleeve in functional connection with the protection fluid chamber, the protection fluid is expelled as the flapper is being opened alleviating jamming of the flapper by debris.

It has been further realized that well tools may fail when there is a pressure fluctuation in the well. The moveable mechanism spreads an uneven load across the shearing members resulting in premature shearing of a shearing member preventing movement of the moveable mechanism. Therefore it may be desired to include a first and a second sleeve in a moveable mechanism and additional breakaway or breakable members. Breakable or breakaway members include, but are not limited to, release mechanism such as collets as detents, shearable ratchets, shear pins, springs, c-rings, dogs, tension rods and other mechanisms known in the art. The sleeves may have ports that facilitate equalization of the pressures encountered in the well. In this manner uniform loads are spread across the breakaway members and a consistent and uniform release of the moveable mechanism is achieved.

A well protection system of the present invention may include a flapper, a housing having a protection fluid chamber in fluid communication with a discharge port positioned proximate the flapper, a protection fluid contained within the protection fluid chamber; a first slide sleeve positioned in moveable connection with the flapper wherein the first slide sleeve is held in a static position by a first breakable member; a second slide sleeve positioned in moveable relation to the first slide sleeve; a load support positioned below the second slide sleeve in a manner supporting the second slide sleeve in a set position; a retainer maintaining the load support in a set position, and a second breakable member maintaining the retainer in a set position.

A method of protecting a well tool allowing full and proper operation may include the steps of supporting a force from a pressure differential across a flapper when the flapper is in a closed position, actuating a first slide sleeve to move the flapper to an open position, parting a first breakable member allowing the first slide sleeve to move, equalizing the pressure differential across the flapper; parting a second breakable member releasing a second slide sleeve for movement, urging a second slide sleeve into movement by movement of the first slide sleeve, moving a load support, expelling the protections fluid, and moving the flapper to the open position.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
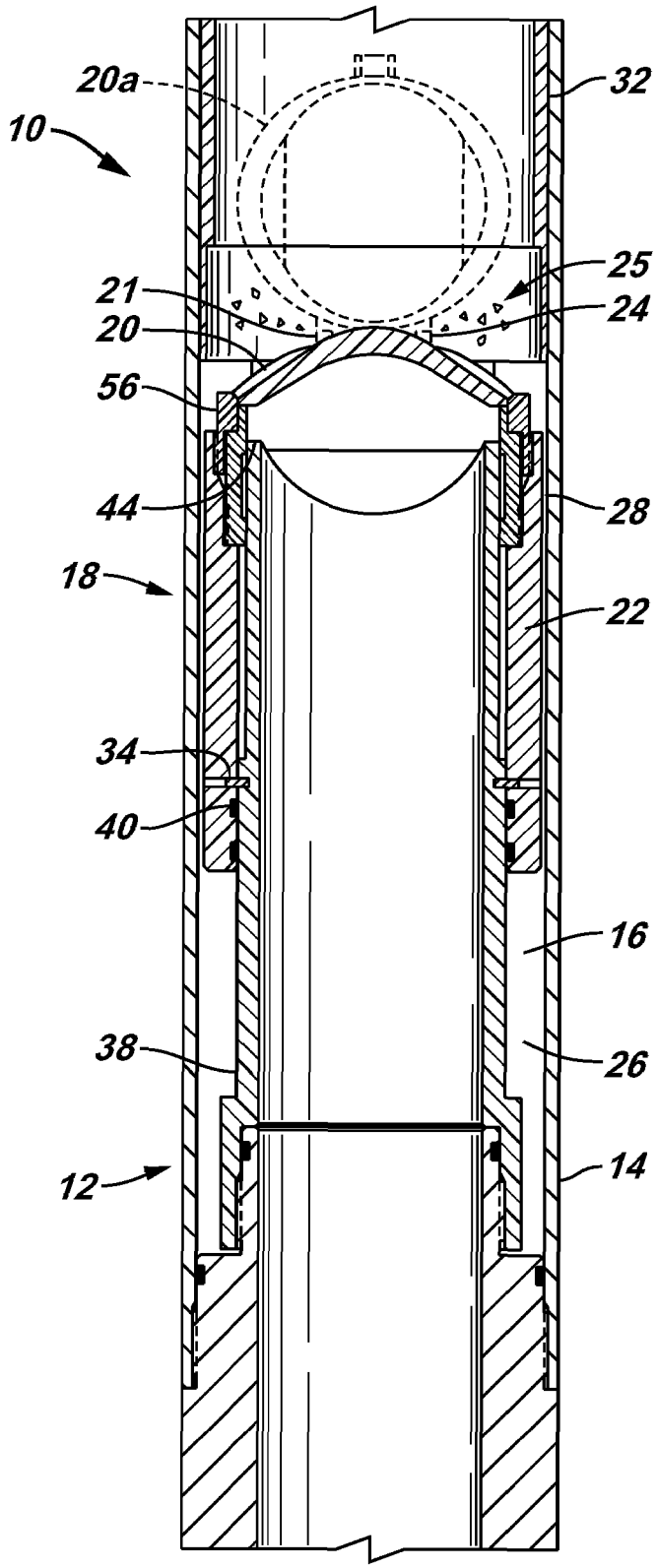
FIG. 1 is a cross-sectional view of a debris removal system of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

Figure 2:
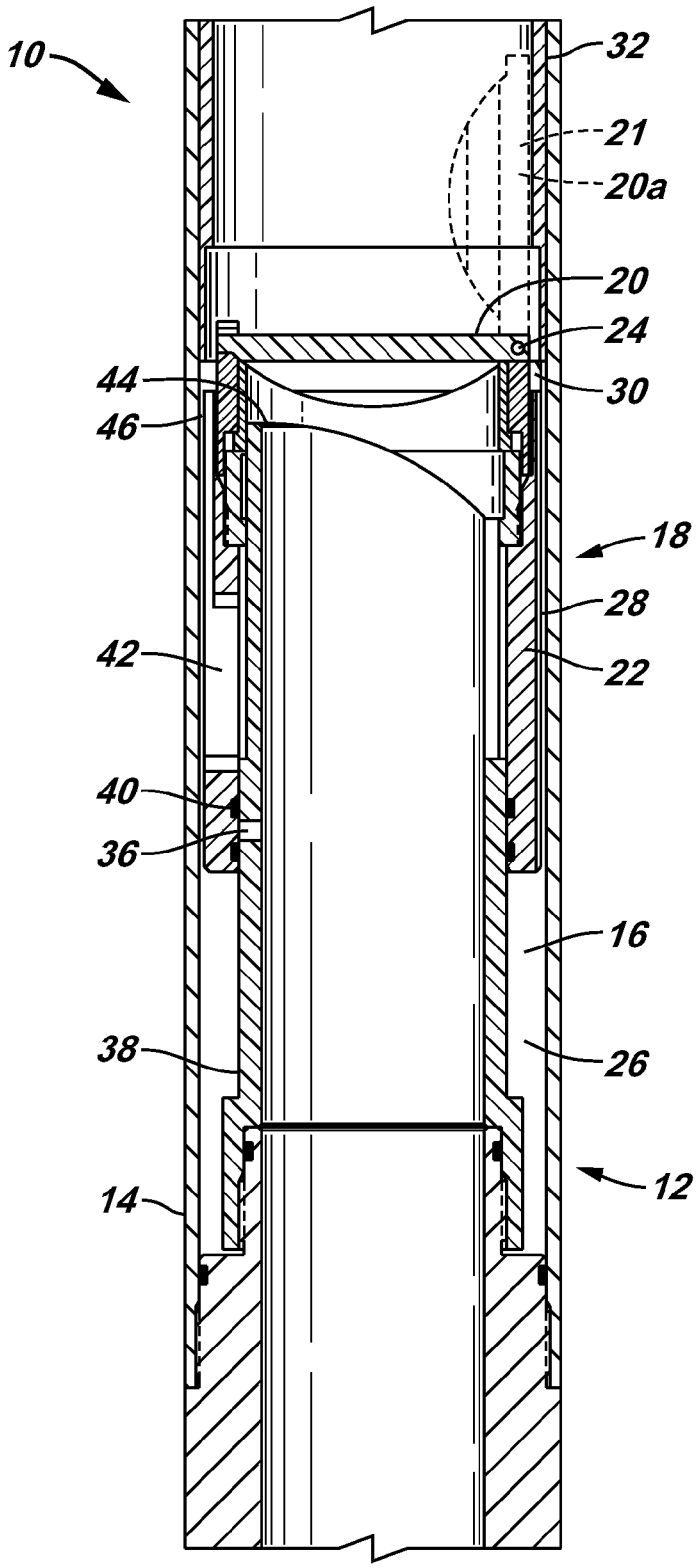
FIG. 2 is cross-sectional view of the debris removal system of the FIG. 1 from a different angle.

FIG. 1 is a cross-sectional view of a debris removal system of the present invention designated generally by the numeral 10. FIG. 2 is a cross-sectional view of debris removal system 10 of FIG. 1 from a different angle. With reference to FIGS. 1 and 2, debris removal system 10 includes a well tool 12 having a housing 14 carrying a protection fluid 16 and a moveable mechanism 18.

Well tool 12 is illustrated as a tubing isolation valve having a flapper 20. In FIGS. 1 and 2 well tool 12 and flapper 20 are in the closed position. For purposes of illustration, flapper 20*a* is superimposed to illustrate flapper 20 in the open position. Moveable mechanism 18 includes a slide sleeve 22 that carries flapper 20. Flapper 20 is pivotedly connected to slide sleeve 22 by a pivot pin 24. Housing 14 forms a protection fluid chamber 26 for carrying protection fluid 16. Protection fluid 16 may be any suitable fluid for removing debris 25 from about moveable mechanism 18. Examples of protection fluid 16 include, but are not limited to, high-viscosity fluids, high-density fluids and jelly type lubricants. It may be desired to include a lubricant in the protection fluid for additional benefits.

Slide sleeve 22 is positioned within protection fluid chamber 26. A protection fluid channel 28, or channels, is formed by a groove in slide sleeve 22. Protection fluid channel 28 has a discharge port 30 in fluid communication with chamber 26. Discharge port 30 may be positioned proximate pivot pin 24 such that protection fluid 16 will be discharged at the back 21 of flapper 20, as flapper 20 is being opened, to remove debris 25 and permit full movement of flapper 20 to the position shown by flapper 20*a*. It should be recognized that discharge port 30 may be positioned in various positions for debris removal. System 10 may include more than one discharge port. Discharge port 30 may be designed for the type of discharge flow desired.

Operation of debris removal system 10 of the present invention is now described with reference to FIGS. 1 and 2. With well tool 12 and flapper 20 in the closed position an operating sleeve 32 is activated moving downward and urging slide sleeve 22 downward. As slide sleeve 22 is urged downward shear pins 34 are sheared releasing slide sleeve 22 carrying flapper 20 for downward movement. The flow ports 36 in flow tube 38 pass seals 40 allowing fluid communication with the large flow ports 42 in slide sleeve 22. It is often desired to include more than one flow port 36 and flow port 42. At this moment, flapper 20 is still separated a distance above flow tube 38. Slide sleeve 22 and flapper 20 continue to move downward as pressure equalizes across flapper 20. As slide sleeve 22 moves downward it displaces protection fluid 16 under pressure through protection fluid channels 28 and discharged through discharge port 30 removing debris 25 from about flapper 20, releasing flapper 20 to move to the open position. As slide sleeve 22 moves downward it carries flapper seat 56 downward. When the tip 44 of flow tube 38 reaches flapper 20, and the pressure across flapper 20 equalizes, flow tube 38 pushes flapper 20 open.

Since protection fluid channel 28 is formed on the same side of slide sleeve 22 as pivot pin 24, protection fluid 16 will only be discharged to the back of flapper 20. Protection fluid 16 will not have significant interaction with the well fluid getting into flow tube 38 through well fluid channels 46.

Debris removal system 10 shown in FIGS. 1 and 2 is adapted for small diameter well tools 12 in low-pressure conditions. When downhole pressure is high, especially in large well tools 12, more and stronger shear pins may be needed to tolerate the load acting of the flapper before opening. Since there may be pressure fluctuations acting on the flapper during well operation, and the multiple shear pins may not take the load uniformly, one of the shear pins might be sheared prematurely causing the tool to malfunction. Therefore a two-step release mechanism may be desired.

Figure 3:
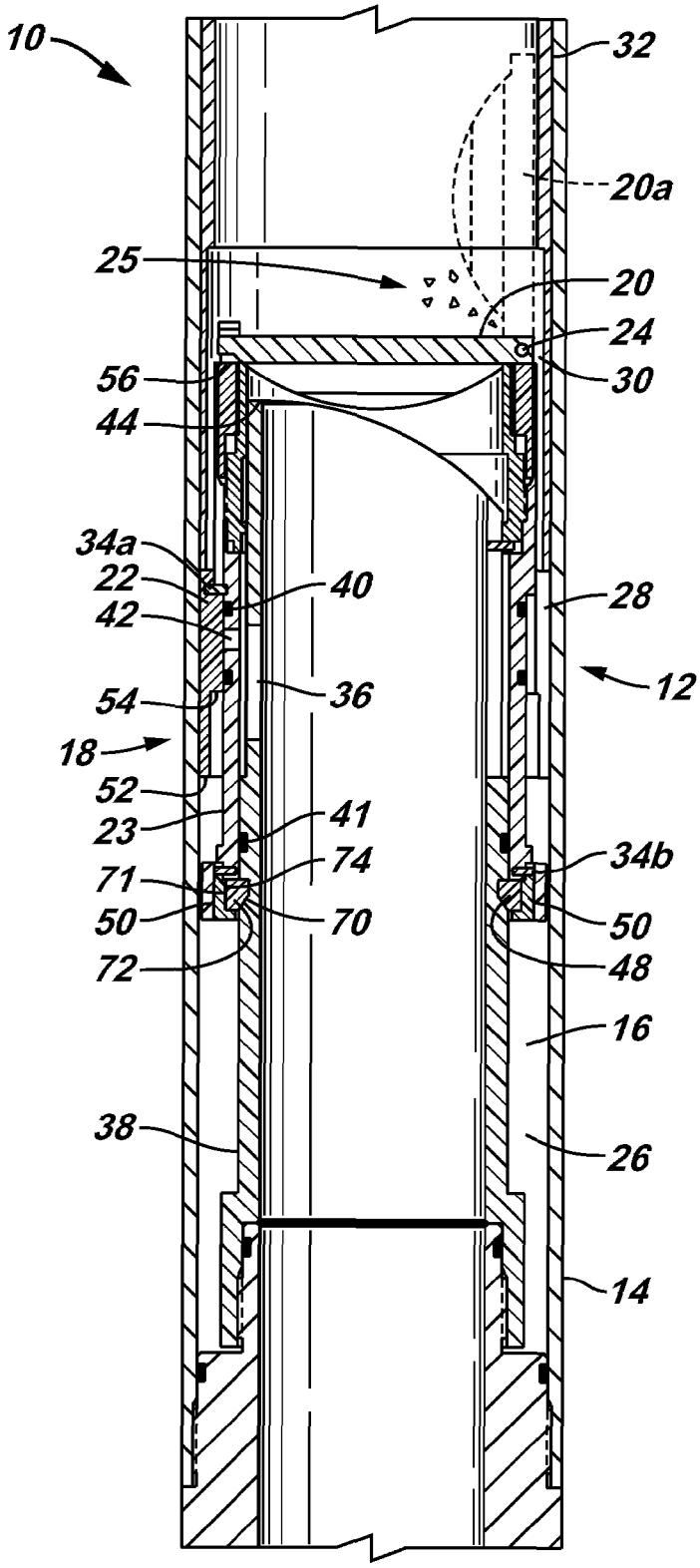
FIG. 3 is cross-sectional view of a debris removal system of the present invention having a two-step release mechanism.

FIG. 3 is a cross-sectional view of a debris removal system 10 of the present invention having a two-step release mechanism. Debris removal system 10 further includes a second slide sleeve 23, a second shear pin 34*b*, load support members 48, and retainer 50.

Before flapper 20 is opened, there is a pressure differential across flapper 20, and the downward load caused by this pressure differential is taken by the load support members 48, which may include but are not limited to split rings. Seal 40 and seal 41 positioned in the outside diameter of flow tube 38 form a differential area. This differential area, with differential pressure, resists downward movement of second slide sleeve 23 until the pressure across flapper 20 is equalized. This minimizes the stress on flapper pin 24 and load support members 48.

Load support members, split rings 48, have a wedge face 70 and is installed in the groove 71 in flow tube 38.

Groove 71 in flow tube 38 also has a wedge face 72 to match the wedge face on split rings 48 to balance the load acting on split rings 48. Meanwhile, the radial load acting on split rings 48 from the ring wedge face 70 is balanced by the inner face 74 of retainer 50. Split rings 48 can be made by cutting a whole ring with a wedge face into multiple pieces along its axial direction. Once retainer 50 is moved away from split rings 48, split rings 48 will be free to be moved out of the groove of flow tube 38.

When operating well tool 12 from the closed to the open position, operating sleeve 32 is actuated to move downward urging moving member 18 including first slide sleeve 22 downward. As first slide sleeve 22 is urged downward the first shear pin 34*a* is sheared releasing first slide sleeve 22 for downward movement. Movement of first slide sleeve 22 downward opens the flow ports 42 in the second slide sleeve 23. The pressure across flapper 20 then equalizes and first slide sleeve 22 continues to move downward.

Because of the equalized pressure the split rings 48 and retainers 50 do not bear a high load. As the lower end 52 of first slide sleeve 22 contacts retainer 50 it breaks second shear pin 34*b*. As the first slide sleeve 22 continues to move downward its shoulder 54 urges the second slide sleeve 23 downward moving split rings 48 out of the groove 71 in flow tube 38. As slide sleeves 22 and 23 move downward protection fluid 16 is discharged through discharge port 30 urging debris 25 from the vicinity of flapper 20. As second slide sleeve 23 moves downward flapper seat 56 moves downward and tip 44 of flow tube 38 moves flapper 20 to an open position.

Figure 4:
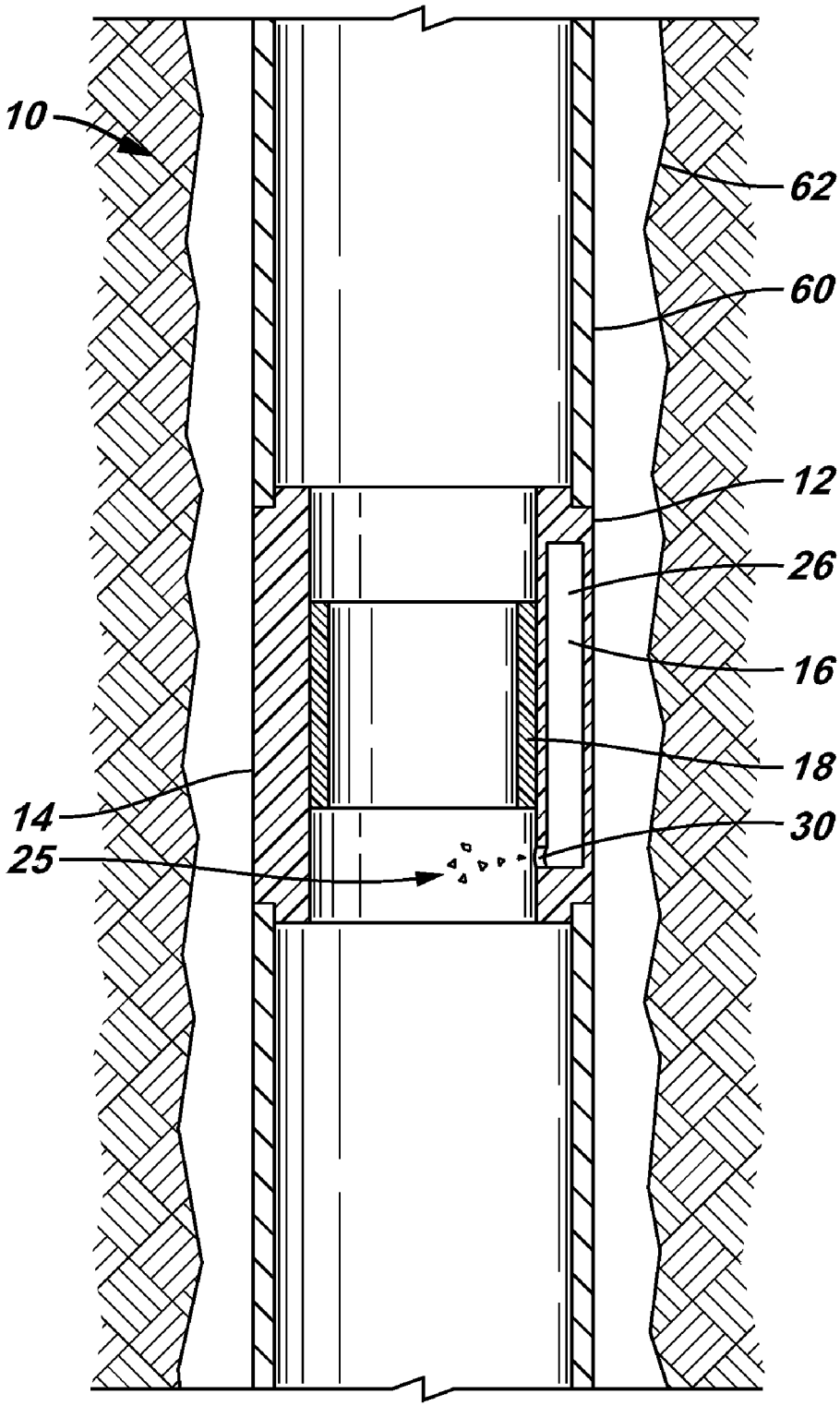
FIG. 4 is a cross-section view of another embodiment of a debris removal system of the present invention.

FIG. 4 is a cross-sectional view of another embodiment of a debris removal system 10 of the present invention. Debris removal system 10 includes a well tool installed in a well 62. Well tool 12 includes a housing 14 that defines a protection fluid chamber 26 carrying a protection fluid 16. A moveable mechanism 18 of well tool 12 is functionally connected to fluid chamber 26 in a manner to force protection fluid 16 from chamber 26 through an annular discharge port 30 when moveable mechanism 18 is moved. When moveable mechanism 18 is moved protection fluid is discharged through annular discharge port 30 removing debris 25 from the vicinity of well tool 12 proximate annular discharge port 30.

With reference to FIGS. 1–4 a method of operating a well tool protection system is provided. A well tool 12 is positioned in a well bore 62. Well tool 12 may be connected to a conduit 60 such as tubing or casing. Well tool 12 includes a housing 14 defining a protection fluid chamber 26 and a discharge port 30 in fluid communication with chamber 26. Housing 14 may include a portion of conduit 60. A protection fluid 16 is maintained in chamber 26. Well tool 12 includes a moveable mechanism 18 for operation. At least a portion of the moveable mechanism is in functional connection with chamber 26 in a manner so as when moveable mechanism 18 moves it expels protection fluid 16 through discharge port 30. Discharge port 30 is positioned in a location where it is desired to remove debris and/or provide a lubricant. As disclosed it may desired to provide a improved release mechanism for moveable mechanism 18 such as increased number of shear pins 34, an additional side sleeve 22 to the moveable mechanism 18 and split-rings 48 and retainers 50.

From the foregoing detailed description of specific embodiments of the invention, it should be apparent that a debris removal system for clearing a moveable mechanism of a well tool and a release mechanism that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow. For example, the invention is described in relation to a flapper type valve such as in a formation isolation valve, tubing isolation valve or safety valve; however, the present invention may be incorporated into any well tools in particular well tools having moveable components.

The invention claimed is:

1. A well tool protection system, the system comprising:
- a flapper;
- a housing having a protection fluid chamber in fluid communication with a discharge port positioned proximate the flapper;
- a protection fluid contained within the protection fluid chamber;
- a first slide sleeve positioned in moveable connection with the flapper wherein the first slide sleeve is held in a static position by a first breakable member;
- a second slide sleeve positioned in moveable relation to the first slide sleeve;
- a load support positioned below the second slide sleeve in a manner supporting the second slide sleeve in a set position;
- a retainer maintaining the load support in a set position; and
- a second breakable member maintaining the retainer in a set position.

2. The system of claim 1 wherein the load support carries a substantial portion of the load from the differential pressure across the flapper when the flapper is in a closed position.

3. The system of claim 1 wherein the load support is positioned within a groove formed in a flow tube.

4. The system of claim 3 wherein the load support has a wedge face that matches a wedge face in the groove formed in the flow tube.

5. The system of claim 4 wherein the load support carries a substantial portion of the load from the differential pressure across the flapper when the flapper is in a closed position.

6. A well tool protection method comprising the steps of:
- supporting a force from a pressure differential across a flapper when the flapper is in a closed position;
- actuating a first slide sleeve to move the flapper to an open position;
- parting a first breakable member allowing the first slide sleeve to move;
- equalizing the pressure differential across the flapper;
- parting a second breakable member releasing a second slide sleeve for movement;
- urging a second slide sleeve into movement by movement of the first slide sleeve;
- moving a load support;
- expelling a protection fluid; and
- moving the flapper to the open position.

7. The method of claim 6 wherein the force from the differential pressure across the flapper is carried substantially by the load support.

8. The method of claim 7 wherein the load support is a split ring.

9. The method of claim 7 wherein the load support is positioned within a groove formed in a flow tube.

10. The method of claim 7 wherein the load support has a wedge face that matches a wedge face in the groove formed in the flow tube.

* * * * *